US005408071A

United States Patent [19]

Ragland et al.

[11] Patent Number: 5,408,071

[45] Date of Patent: Apr. 18, 1995

[54] ELECTRIC HEATER WITH HEAT DISTRIBUTING MEANS COMPRISING STACKED FOIL LAYERS

[75] Inventors: G. William Ragland, Dunwoody, Ga.; Boyd A. Barnard, St. Louis, Mo.

[73] Assignee: ATD Corporation

[21] Appl. No.: 63,577

[22] Filed: May 19, 1993

Related U.S. Application Data

[63] Continuation-in-part of Ser. No. 897,080, Jun. 11, 1992, abandoned.

[51] Int. Cl.[6] ..... H05B 3/06; H05B 3/02; H05B 3/54

[52] U.S. Cl. ..... 219/530; 219/540; 219/549; 219/528; 219/219; 219/202; 165/46

[58] Field of Search ..... 219/530, 540, 548, 549, 219/528, 219, 211, 212, 202; 165/135, 136, 133, 46, 171, 56, 49; 220/424, 425, 440, 450, 442; 338/306

[56] References Cited

U.S. PATENT DOCUMENTS

| | | | |
|---|---|---|---|
| 1,815,570 | 7/1931 | Jones | 165/185 |
| 1,910,703 | 5/1933 | Le Grand . | |
| 1,934,174 | 11/1933 | Dyckerhoff . | |
| 1,974,665 | 9/1934 | Schnetzer et al. . | |
| 1,987,798 | 1/1935 | Ruppricht . | |
| 2,010,180 | 8/1935 | De Ferranti | 392/346 |
| 2,110,660 | 3/1938 | Doczekal | 392/436 |
| 2,170,937 | 8/1939 | Bruning | 220/450 |
| 2,180,373 | 11/1939 | Sibley et al. . | |
| 2,212,481 | 8/1940 | Sendzimir . | |
| 2,312,987 | 3/1943 | Grassick | 220/450 |
| 2,441,476 | 5/1948 | Ewald . | |
| 2,481,046 | 9/1949 | Scurlock . | |
| 2,512,875 | 6/1950 | Reynolds | 392/435 |
| 2,668,692 | 2/1954 | Hammell | 165/135 |
| 2,783,358 | 2/1957 | Wolf | 219/530 |
| 2,926,761 | 3/1960 | Herbert, Jr. . | |
| 2,962,811 | 12/1960 | Herbert, Jr. . | |
| 2,963,128 | 12/1960 | Rapp . | |
| 2,967,225 | 1/1961 | Carrier, Jr. et al. | 219/540 |
| 3,029,910 | 4/1962 | Kirk et al. . | |
| 3,175,958 | 3/1965 | Bourgade | 165/136 |
| 3,190,412 | 6/1965 | Rutter et al. . | |
| 3,244,224 | 4/1966 | Hnilicka, Jr. | 165/136 |
| 3,387,333 | 6/1968 | Irvine et al. | 219/540 |
| 3,629,549 | 12/1971 | Svendsen | 219/388 |
| 3,958,714 | 5/1976 | Barriere et al. . | |
| 4,025,996 | 5/1977 | Saveker . | |
| 4,037,751 | 7/1977 | Miller et al. | 165/136 |
| 4,318,965 | 3/1982 | Blair . | |
| 4,343,866 | 8/1982 | Oser et al. . | |
| 4,344,591 | 8/1982 | Jackson . | |
| 4,386,128 | 5/1983 | Yoshikawa . | |
| 4,425,497 | 1/1984 | Leary et al. | 219/540 |
| 4,430,553 | 2/1984 | Antimovski | 165/96 |
| 4,703,159 | 10/1987 | Blair . | |
| 4,759,964 | 7/1988 | Fischer et al. . | |
| 4,954,676 | 9/1990 | Rankin | 219/540 |
| 5,011,743 | 4/1991 | Sheridan et al. . | |
| 5,015,824 | 5/1991 | Monter et al. | 219/219 |

FOREIGN PATENT DOCUMENTS

| | | | |
|---|---|---|---|
| 2495875 | 6/1982 | France | 219/528 |
| 2666717 | 3/1992 | France | 219/549 |
| 126780 | 5/1919 | United Kingdom . | |
| 471175 | 8/1937 | United Kingdom . | |
| 783184 | 9/1957 | United Kingdom . | |

*Primary Examiner*—Bruce A. Reynolds
*Assistant Examiner*—John A. Jeffery
*Attorney, Agent, or Firm*—Burns, Doane, Swecker & Mathis

[57] ABSTRACT

A heat distributing device which includes a concentrated heat source and a stack of metal foils wherein the heat source is encapsulated between two of the layers of metal foil. The heat source can be a resistance heated wire which extends linearly and has a free end spaced inwardly from an end of the stack. The outer edge of the stack can be open or sealed. The stack can include metal wool and/or insulating material between layers of the metal foil. The heat distributing device can be used to provide uniform heating across an outermost layer of the metal foil. For instance, the heat distributing device can be used to heat a side-view mirror of an automobile.

31 Claims, 4 Drawing Sheets

ELECTRIC HEATER WITH HEAT DISTRIBUTING MEANS COMPRISING STACKED FOIL LAYERS

BACKGROUND OF THE INVENTION

The present application is a continuation-in-part of Ser. No. 07/897,080, filed Jun. 11, 1992, now abandoned.

The present application is related to commonly-owned U.S. Pat. No. 5,011,743, the subject mater of which is hereby incorporated by reference.

1. Field of the Invention

The present invention relates to heat distributing devices and more particularly, to heat distributing devices which can provide a uniform distribution of heat over a large area from a concentrated heat source.

2. Description of Related Art

Heat distributing devices such as heating pads are known in the art. Such devices include a heating element such as a resistance heated wire which extends in a pattern over the entire heating pad surface. Such devices are costly due to the amount of resistance heating wire required and due to the complexity of manufacturer thereof.

Also known in the art is an electrically conductive polymer made by Raychem Corporation, located in Menlo Park, Calif. Such conductive polymer material has been used for heating exterior side-view mirrors of automotive vehicles.

There is a need in the art for a heat distributing device which is simple to manufacture and which consists of low-cost materials.

SUMMARY OF THE INVENTION

The invention provides a heat distributing device which includes a heat source encapsulated in a stack of layers of metal foil. The heat source can be a concentrated heat source and the stack can have a relatively large surface area. The layers of foil are arranged one above another with the heat source between two of the layers. The layers of the metal foil can be spaced apart by one or more open spaces therebetween. For instance, the stack can include at least three non-perforated layers of the metal foil, each of the layers including a plurality of embossments so as to provide air gaps between the layers.

According to one embodiment of the invention, the heat source comprises an electrical resistance heating element embedded in the stack such that a plurality of layers of the metal foil are located on one or both sides of the electrical resistance heating element. One or more of the layers of metal foil can include a plurality of embossments therein separating the layers. For instance, the stack can include ten layers with five embossed layers of aluminum foil on each side of the heating element.

The layers of metal foil can be of aluminum, an aluminum alloy, stainless steel or another suitable metal having a thickness which allows the stack to be manually deformed. The stack can be sealed or open along its edges. If sealed, the stack can include a gas such as air or an inert gas such as argon or nitrogen between the layers. At least one of the layers of metal foil can include a black coating of uniform or non-uniform thickness on at least one side thereof. For instance, the black coating can cover part or all of an outer surface of the stack. The stack can include additional material between layers of the metal foil. For instance, the additional material can comprise a mass of entangled fibers or strips of metal (such as aluminum or steel wood or other material such as glass and/or one or more sheets of a material having poor heat conductance (such as flame retardant polyester, refractory paper, fiberglass non-woven fabric, ceramic non-woven fabric, etc.).

According to one aspect of the invention, the heat source can comprise an electrical resistance heating element such as a rigid or flexible rod or wire of resistance heating material, an electrically conductive metal rod or wire coated with a layer of non-electrically conductive material, an electrically conductive polymer material or other suitable material or a conduit for a fluid heating medium such as gas or water. For instance, the heating element can consist of a linearly extending electrical resistance heated rod which is ⅛ inch in diameter and the stack can be at least 6 inches wide.

Although a wide variety of heat sources may be used with the present invention, Ni-chrome wire and other uninsulated wire-type heating elements have been found to provide cost-effective heating elements. Since these uninsulated wire-type heating elements may short circuit if they are allowed to contact the metal foil, a tube made of glass or other electrically insulating material may be placed in the layers of metal fill to house the heat source. The glass tube will keep the wire from contacting the metal foil and, at the same time, allow radiant and/or conductive heat energy to be transferred to the metal foil.

One advantage of the heat distributing device of the invention is that a relatively small heat source can be used to uniformly distribute heat over a large area. For instance, the heat source can be effective for heating the outermost layer of the stack so that it rises by at least 100° F. to a substantially uniform temperature which varies no more than ±5° F. at any location on the outermost layer. Another advantage is that a high intensity heat source can be used to distribute heat at a much lower temperature. That is, the stack can maintain temperature differentials of over 100° F. or even 200° F. and higher between the heating element and the outer layer of the stack. For instance, the stack can maintain a temperature differential of at least 200° F. between the outer layer and the heating element when the stack includes four layers of the metal foil between the heat source and the outer layer and electrical resistance heating element is heated to at least 400° F.

DETAILED DESCRIPTION OF THE INVENTION

Figure 1:
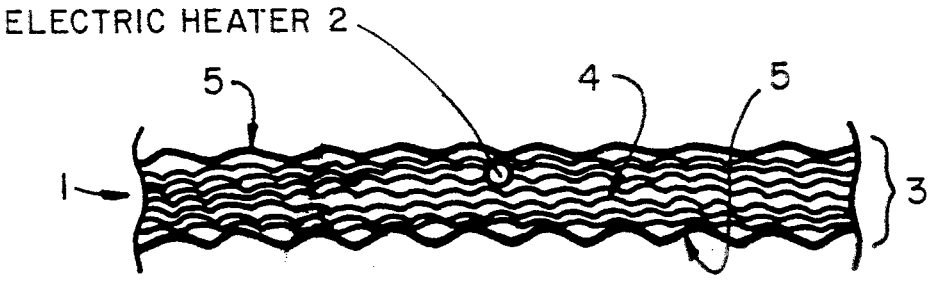
FIG.1 shows a lateral cross-section of part of a heat distributing device in accordance with the invention.

The invention provides a heat radiating device which includes a plurality of layers of material which transmits heat laterally. In particular, the layers form a stack and are separated by insulating spaces between the laterally conducting layers such that heat from a concentrated source is spread uniformly across one or both of the outermost layers. The uniform spread of heat can also be aided by varying the area of contact between the conducting layers such that flow perpendicular to the composite layers is restricted in the area of the heat source. Heat flow between the layers can be increased at a distance from the heat source by increasing contact between the conducting layers and/or reducing the insulation value between layers. For instance, this can be done by varying the size and shape of embossments in the layers and/or by providing discrete inserts between layers if air gap insulation is used.

In tests performed on heat distributing devices in accordance with the invention, significant heat flow was detected at the open edge of composites under test. This flow was greatly reduced when the edge was folded back on itself and crimped. A crushed edge (e.g., compressed edge of the composite) still showed a considerable amount of infrared radiation. In particular, a composite having an open edge with a 932° F. heat source produces 1000 $w/m^2$ for a 6" batt and 500 $w/m^2$ for a 12" batt. A composite having a closed edge with a 932° F. heat source produces 130 $w/m^2$ for a 6" batt. The surface radiation was 44 $w/m^2$.

Heat flow from an open edge reduced linearly with the distance increase of the edge from the heat source, probably due to increased incidence of reflection back into the composite as more embossments were placed in the light path (IR).

The material can be differentially embossed to maintain a substantially flat composite. If a tapered composite is used, the embossed material can be differentially crushed to reduce the insulation value between layers. It may be desirable, however, to maintain a constant surface temperature across a large surface from a concentrated heat source. If the laterally conducting material has a low surface emissivity, uniformity of surface temperature can be aided by painting or otherwise coating one or both surfaces of each layer in areas away from the heat source to increase flow between layers. Painting entire layers black increases the flow from the heat source to ambient. By blackening the layers of the top section of a composite in which a heat source is sandwiched between equal numbers of layers of foil, the heat can be directed to the black side and still maintain a relatively uniform surface temperature. The results of temperature measurements are set forth in the following tables.

Various embodiments of the invention are shown in FIGS. 1–6. The heat distributing device 1 in accordance with the invention includes a heat source 2 and a stack 3 of layers of metal foil 4,5 wherein the layers of foil are arranged one above another. At least some or all of the layers of the metal foil are spaced apart sufficiently to allow thermal convection therebetween. The heat source 2 is encapsulated between layers of the metal foil such that a plurality of layers of the metal foil are on one side of the heat source and at least one layer of the metal foil is on an opposite side of the heat source.

As shown in FIG. 1, the heat source 2 is located between an outermost layer 5 of the metal foil and an inner layer 4 of the metal foil. To provide thermal convection between the layers of metal foil, the layers can be embossed such that the layers are in point contact with each other. To prevent the layers from nesting, the embossed pattern between the layers can be varied. For instance, the inner layers 4 can include a diamond shape wherein the points of the embossments are spaced apart by 0.2 inches. To prevent nesting of the inner layers 4, the embossed pattern can be oriented in different directions for each layer. For instance, one of the inner layers 4 can include a diamond pattern wherein the points are located along lines which are perpendicular to each other and the adjacent inner layer 4 can include a diamond pattern wherein the points are along lines which are at an acute angle to each other. For instance, the acute angle could be 22 degrees. The choice of the embossed pattern, however, will be apparent to those skilled in the art.

The outermost layer 5 of the top and/or bottom of the stack 3 can be embossed or flat. For instance, the outermost layer 5 can include a diamond pattern wherein the points of the pattern are spaced apart by 0.5 inch. Depending on the use of the heat distributing device 1, it may be desirable to provide a flat outer surface rather than an embossed surface on the top and/or bottom stack 3.

Figure 2:
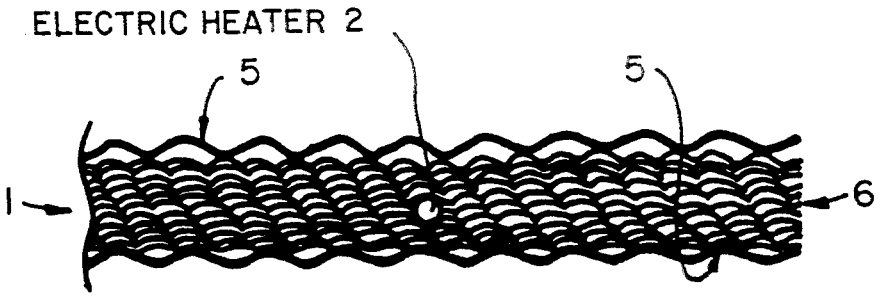
FIG.2 shows a lateral cross-section of part of another heat distributing device in accordance with the invention.

In the embodiment shown in FIG. 1, the heat source 2 is located adjacent one of the outermost layers 5 of the stack 3. However, it may be desirable to provide the heat source in the center of a stack of the metal foils, as shown in FIG. 2. The FIG. 1 arrangement can result in undesirable heat loss through the outermost layer 5 located closest to the heat source 2. However, such heat loss can be compensated by backing the outermost layer 5 with suitable insulating material.

Figure 3:
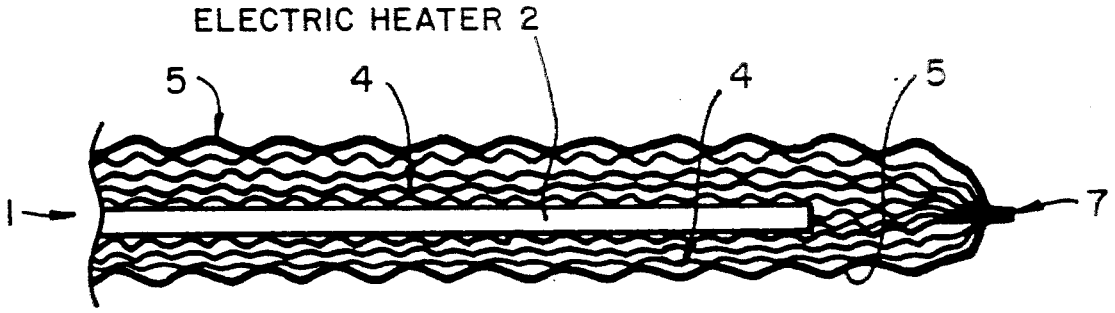
FIG.3 shows a longitudinal cross-section of part of another heat distributing device shown in FIG.2.

The heat distributing device 1 can include an open edge 6 (as shown in FIG. 2) or a sealed edge 7 (as shown in FIG. 3). The sealed edge 7 can be formed by compressing the edge of the stack and/or securing the layers with suitable means such as staples, adhesive, etc. The entire outer periphery of the stack 3 can be open or part or all of the outer edge can be sealed. In addition, as shown in FIG. 3, the heat source 2 can extend rectilinearly through the stack 3 with a free end of the heat source 2 being located inwardly from an outer edge of the stack. Of course, the heat source can have other configurations and the free end or ends of the heat source can be located outwardly of the stack 3.

Figure 4:
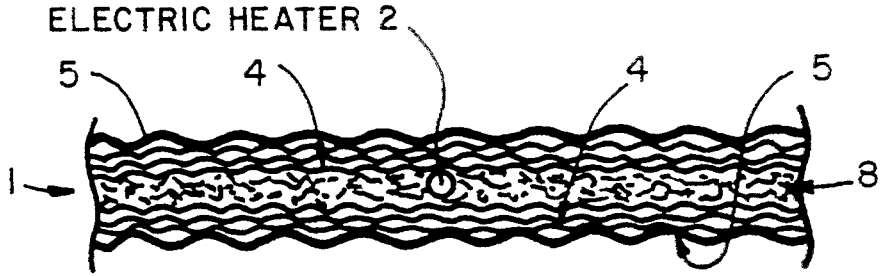
FIG. 4 shows a lateral cross-section of part of another heat distributing device in accordance with the invention.

As shown in FIG. 4, the heat distributing device 1 can include material other than metal foil. For instance, metal wool 8 can be provided between the inner layers 4 facing the heat source 2. The metal wool 8 can also be provided between inner layers 4 and/or between the outermost layers 5 and the adjacent inner layers 4.

Figure 5:
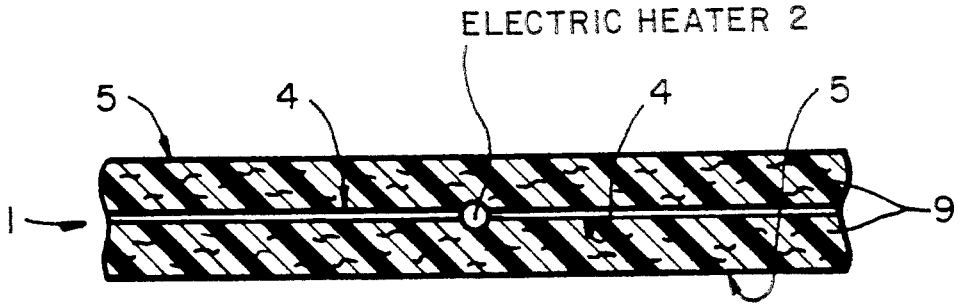
FIG. 5 shows a lateral cross-section of part of yet another heat distributing device in accordance with the invention.

FIG. 5 shows another arrangement of the heat distributing device 1. In this case, the heat source 2 is between adjacent inner layers 4 and insulating material 9 is located between the inner layers 4 and the outermost layers 5. The outermost layers 5 can be flat (as shown in FIG. 5) or the outermost layers 5 and/or the inner layers 4 can be embossed as described earlier.

Figure 6:
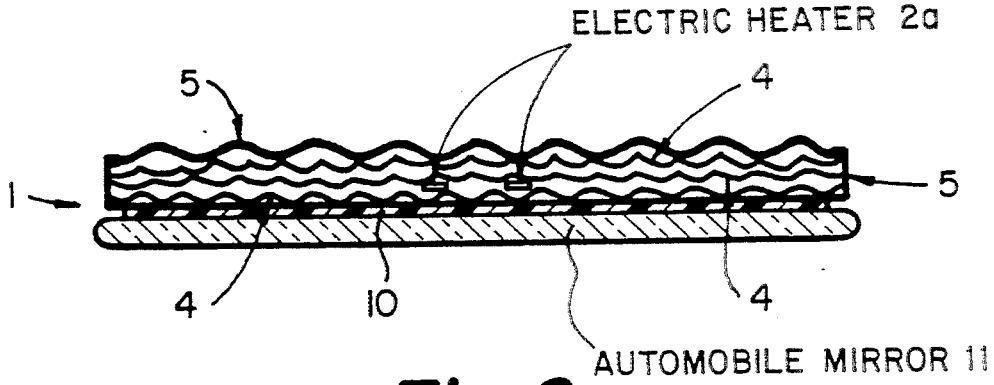
FIG. 6 shows a lateral cross-section of part of a heat distributing device in accordance with the invention mounted on a rear-surface of a mirror.

FIG. 6 shows an application wherein the heat distributing device 1 is used to heat a mirror. In particular, one outermost layer 5 is flat and bonded by means of adhesive 10 to the rear side of an external side mirror 11 of a vehicle. The layers 4 can be 0.002 inch thick aluminum foil and some of the layers can have embossed patterns which are reversed, i.e., the points extend away from each other. The outermost layers 5 can be 0.004 inch thick aluminum foil and the layer 5 facing the mirror 11 can be folded around the other outermost layer 5 to provide a sealed edge. The inner layers 4 preferably are held loosely within the sealed edge, that is, the sheets 4,5 are not bonded (metallurgically or otherwise) to each other. Not shown are the electronic components such as a thermistor to prevent overheating of the heater *2a*. The heat source can comprise a single thin U-shaped strip 22 of insulated electric resistance heating material such as the type of material (nichrome) used to form filaments in an electric toaster. Such filaments can reach temperatures of 1000° F. when used as the heating element in accordance with the invention. It has been found that a heating element having a resistance of 6 Ω and producing 24 watts at 12 volts is sufficient to heat the mirror 11 from −32° F. to =32° F. within 2 minutes.

Figure 7:
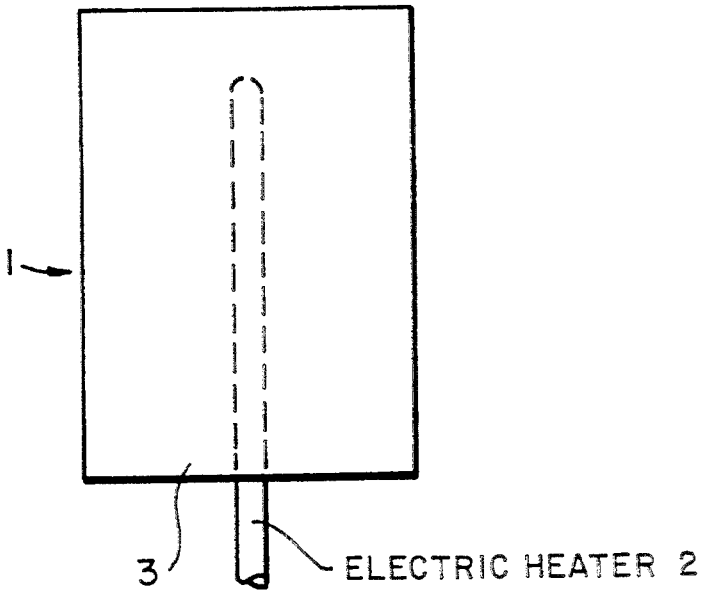
FIG. 7 is a top view of a heat distributing device in accordance with the invention wherein the, heat source comprises a tubular heater.

FIG. 7 shows a top view of a heat distributing device in accordance with the invention. In particular, the heat source 2 comprises a tubular heater (like the type used in heating electric ovens) and the heater extends rectilinearly in the center of the stack 3 with a free end of the heater spaced inwardly from an edge of the stack.

Figure 9:
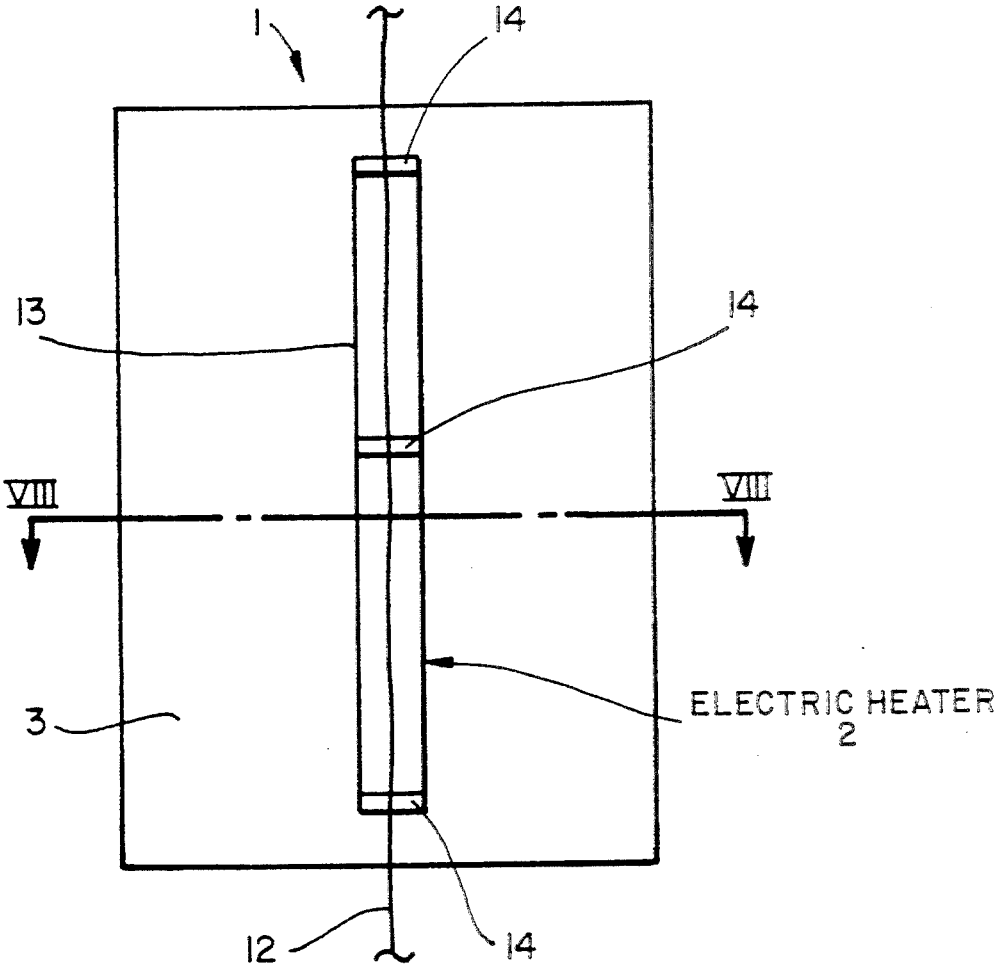
FIG. 9 is a top cross-sectional view taken along line IX—IX in FIG. 8.
Figure 8:
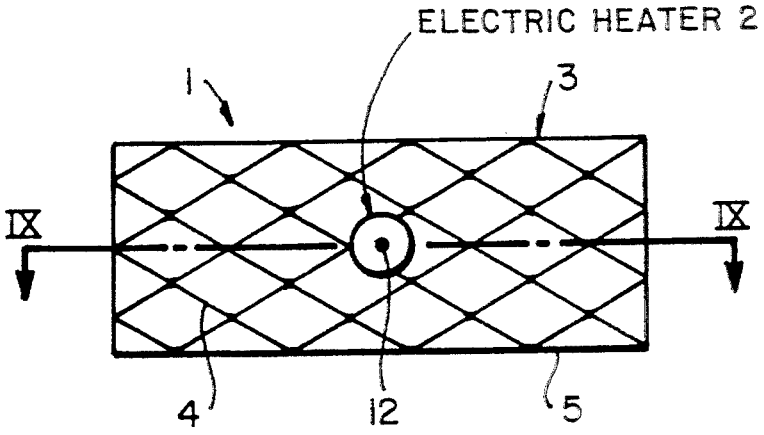
FIG. 8 is a side cross-sectional view taken along line VIII—VIII in FIG. 9 of a heat distributing device in accordance with the invention wherein a resistance heating filament passes through both ends of a tube.

FIG. 8 shows a side cross section of an arrangement wherein a heat distributing device 1 in accordance with the invention includes an electric resistance heating filament 12 supported inside a tube 13 by electrically insulating spacers 14. The tube is totally encapsulated by the stack 3 of metal foils 4 and the filament 12 passes through both ends of the tube with one end of the filament extending out one side of the stack 3 and the other end of the filament extending out the other side of the stack. FIG. 9 shows a top cross section of the stack shown in FIG. 8.

Figure 11:
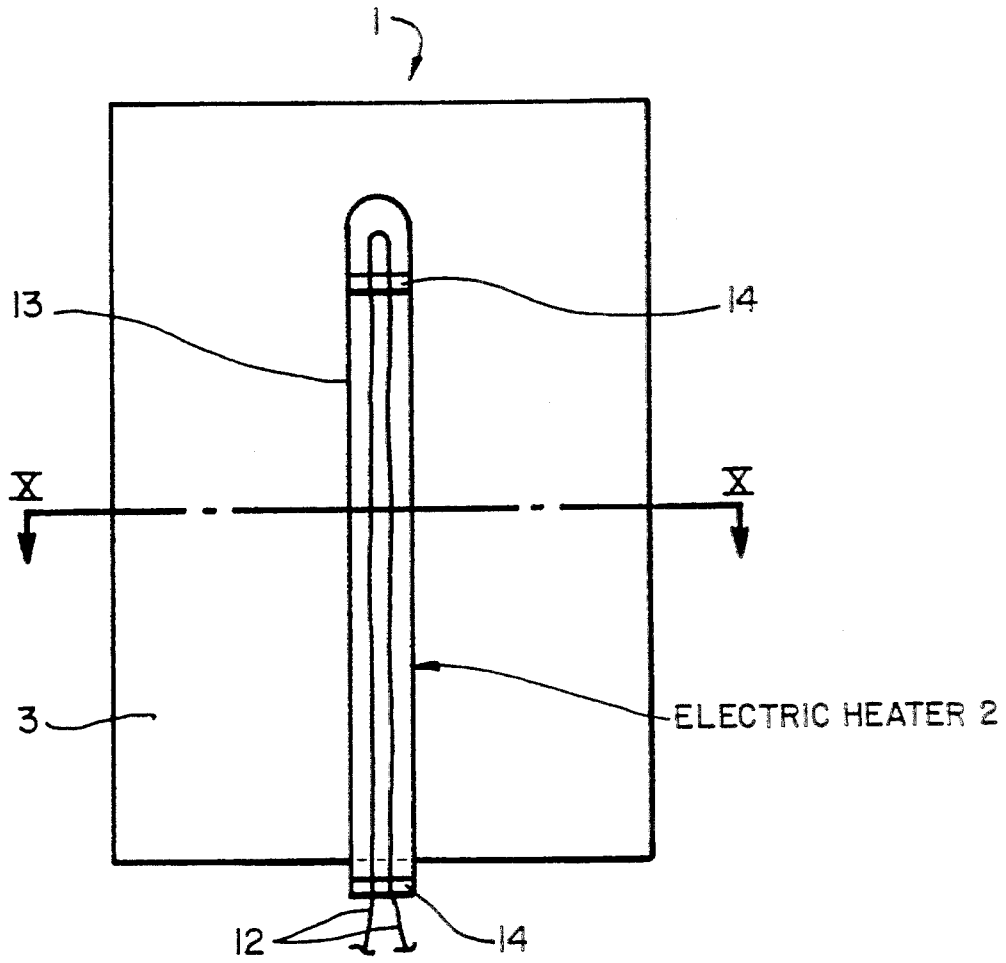
FIG.11 is a top cross-sectional view taken along line X-X in FIG. 10.
Figure 10:
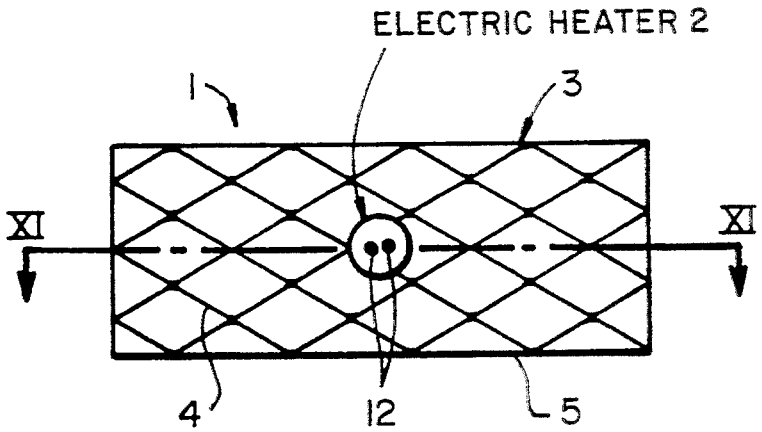
FIG. 10 is a side cross-sectional view taken along line X—X in FIG. 11 of a heat distributing device in accordance with the invention wherein both ends of a resistance heating filament pass-through one end of a tube.

FIG. 10 shows a side cross section of another arrangement wherein both ends of the filament 12 pass through one end of the tube 13. FIG. 11 shows a top cross section of the stack shown in FIG. 10.

One material for the filament 12 which has been found to be particularly effective is a metal alloy including nickel and chromium. This type of filament material is generally referred to as Ni-chrome (or nichrome) wire which has excellent thermal radiation properties and is also heat resistant. However, any other type of heat producing filament, besides Ni-chrome wire, could also be used. The portion of the filament inside the tube can be bare, i.e. without a protective coating. Portions of the filament outside the tube are preferably provided with a coating of electrically insulative material such as ceramic, teflon or fiberglass.

The tube 13 may be formed from any electrically insulating material such as glass, ceramic, fiberglass, ceramic coated fiberglass, or nonconductive plastic. The tube 13 may be formed in a variety of cross-sectional shapes such as round, square, and hexagonal. A 3/16" cylindrical tube has been found to be particularly useful.

The tube 13 is preferably formed from a heat resistant material such as pyrex glass. The filament 12 is then threaded inside the tube 13. The space between filament 12 and the inside wall of tube 13 allows room for filament 12 to change shape inside tube 13, such as by thermal expansion and contraction. Although the filament 12 may simply rest against the inside surface of the tube 13, it has been found preferable to support the filament 12 by means of spacers 14 in order to provide a space between the filament 12 and the walls of tube 13. The spacers 14 may be located at each end of the tube 13, and/or located along the length of the tube 13, to support filament 12. However, the filament can be supported within the tube without spacers 14. For instance, the filament can be held loosely in the tube and the open end or ends of the tube can be sealed with an electrically insulating material such as high temperature silicone rubber.

The tube 13 may be evacuated or filled with a variety of fluids such as air, nitrogen, inert gas, and/or other gases. The tube 13 may also be filled with liquids such as water, oil, and/or dielectric fluids. Alternatively, the filament 12 can be omitted and the tube 13 can be used to circulate a heated fluid medium, such as hot water or steam.

The filament 12 could also be supported in the stack 3 without the tube 13, such as by forming a passage in heat distributing device 1 for receiving the filament 12 and, if desired, the filament could be supported within the stack via spacers 14. The sides of the passage in the stack 3 may be coated with an insulating coating, such as rubber or plastic, in order to prevent the filament 12 from being short circuited by the edges of the layers of metal foil 4, 5 bordering the passage.

The filament can be connected to an electrical power supply with a conventional high temperature wire having an electrically insulative outer coating. The filament and wire can be electrically connected together by a mechanical connection or by a metallurgical bonding technique such as soldering. The filament can be heated by passing AC or DC electrical energy therethrough.

The following examples illustrate aspects of the invention.

EXAMPLE 1

A rectilinearly extending ⅛" O.D. ×50" length tubular electric resistance heater was completely encapsulated in the center of two 6"×52" assemblies such that ends of the heater were spaced 1" inwardly from opposite edges of the 6" sides of the composite. Each of the assemblies included five layers of embossed, aluminum foil (2 mil) sheets and outer edges of each of the composites were mechanically bonded to seal the outer edges together. The objective was to create a uniform temperature across each composite by applying heat from a relatively small heat source. The results of temperature measurements are set forth in Table 1. During these tests, the bottom surface of the composite rested on a support and the top surface of the composite was exposed to still air at about 70° F. Temperatures were measured at the center of the top surface ($T_1$), the outer edge of the top surface of one of the 52" sides ($T_2$), the center of the bottom surface ($T_3$), the heat source ($T_4$) and the outer edge of the bottom surface of one of the 52" sides ($T_5$). In this case, $T_2$ and $T_5$ were about 3" away from the heat source. The bottom surface of the second composite was painted black and the top surface of the third composite was painted black.

TABLE 1

| Location of Measured Temperature | Measured Temperatures (°F.) Both Sides Bright | Bottom Surface Painted Black | Top Surface Painted Black |
|---|---|---|---|
| Top Surface Center $T_1$ | 150 | 139 | 121 |
| Top Surface Edge $T_2$ | 155 | 135 | 117 |
| Bottom Surface Center $T_3$ | 202 | 186 | 172 |
| Heater Wire Center $T_4$ | 500 | 500 | 500 |
| Bottom Surface Edge $T_5$ | 182 | 181 | 168 |

EXAMPLE 2

A rectilinearly extending ⅛" O.D. ×50" length tubular electric resistance heater was completely encapsulated in the center of two 6"×53" assemblies, two 12"×53" assemblies, two 18"×53" assemblies and two 24"×53" assemblies. The ends of the heater were spaced 1.5" inwardly from opposite edges of the 6" sides, the 12" sides, the 18" sides and the 24" sides, respectively, of the composites. Each of the assemblies included five layers of embossed, aluminum foil (2 mil) sheets and outer edges of each of the composites were mechanically bonded to seal the outer edges together. The objective was to create a uniform temperature across each composite by applying heat from a relatively small heat source. The results of temperature measurements are set forth in Table 2. During these tests, the bottom surface of the composite rested on a support and the top surface of the composite was exposed to still air at about 70° F. Temperatures were measured at the center of the top surface ($T_1$), the outer edge of the top surface of one of the 53" sides ($T_2$), the center of the bottom surface ($T_3$), the heat source ($T_4$), the outer edge of the bottom surface of one of the 53" sides ($T_5$) and halfway between $T_1$ and $T_2$. In this case, $T_2$ and $T_5$ were about 3" away from the heat source in the 6" wide composite, 6" away from the heat source in the 12" wide composite, 9" away from the heat source in the 18" wide composite and 12" away from the heat source in the 24" wide composite.

TABLE 2

| Location of Measured Temperatures | Measured Temperatures (°F.) & Composite Dimensions 6" × 53" Both Sides Bright | 12" × 53" Both Sides Bright | 18" × 53" Both Sides Bright | 24" × 53" Both Sides Bright |
|---|---|---|---|---|
| $T_1$ Top Center | 180 | 147 | 123 | 125 |
| $T_2$ Top Edge | 184 | 142 | 103 | 91 |
| $T_3$ Bottom Center | 237 | 208 | 166 | 158 |
| $T_4$ Heat Source | 500 | 500 | 500 | 500 |
| $T_5$ Bottom Edge | 219 | 175 | 116 | 100 |

TABLE 2-continued

| Location of Measured Temperatures | Measured Temperatures (°F.) & Composite Dimensions 6" × 53" Both Sides Bright | 12" × 53" Both Sides Bright | 18" × 53" Both Sides Bright | 24" × 53" Both Sides Bright |
|---|---|---|---|---|
| $T_6$ Top Between $T_1$ & $T_2$ | | | 107 | 100 |

EXAMPLE 3

A rectilinearly extending ⅛' O.D. ×50" length tubular electric resistance heater was encapsulated in the center of two 8"×8" and two 24"×24" assemblies such that ends of the heater extended beyond opposite edges of the composites. Each of the assemblies included five layers of embossed, aluminum foil (2 mil) sheets and outer edges of each of the composites were mechanically bonded to seal the outer edges together. The objective was to create a uniform temperature across each composite by applying heat from a relatively small heat source. The results of temperature measurements are set forth in Table 3. During these tests, the bottom surface of the composite rested on a support and the top surface of the composite was exposed to still air at about 70° F. Temperatures were measured at the center of the top surface ($T_1$), the outer edge of the top surface of one of the sides parallel to the heat source ($T_2$), the center of the bottom surface ($T_3$), the heat source ($T_4$), the outer edge of the bottom surface of one of the sides parallel to the heat source ($T_5$) and halfway between $T_1$ and $T_2$ ($T_6$). In this case, $T_2$, and $T_5$ were about 4" away from the heat source in the 8"×8" composite and about 12" away from the heat source in the 12"×12" composite.

TABLE 3

| Location of Measured Temperatures | Measured Temperatures (°F.) & Composite Dimensions 8" × 8" | 24" × 24" |
|---|---|---|
| $T_1$ Top Center | 138 | 152 |
| $T_2$ Top Edge | 106 | 98 |
| $T_3$ Bottom Center | 179 | 180 |
| $T_4$ Heat Source | 500 | 500 |
| $T_5$ Bottom Edge | 120 | 107 |
| $T_6$ Top Between $T_1$ & $T_2$ | 112 | 105 |

EXAMPLE 4

A rectilinearly extending ⅛" O.D. ×50" length tubular electric resistance heater was completely encapsulated in the center of two 6"×53" assemblies such that ends of the heater were spaced 1.5" inwardly from opposite edges of the 6" sides of the composites. Each of the assemblies included five layers of embossed, aluminum foil (2 mil) sheets and outer edges of the composites were mechanically bonded to seal the outer edges together. The objective was to create a uniform temperature across each composite by applying heat from a relatively small heat source. The results of temperature measurements are set forth in Table 4. During these tests, the bottom surface of the composite rested on a support and the top surface of the composite was exposed to still air at about 70° F. Temperatures were measured at the center of the top surface ($T_1$), the outer edge of the top surface of one of the 53" sides ($T_2$), the center of the bottom surface ($T_3$), the heat source ($T_4$) and the outer edge of the bottom surface of one of the 53" sides ($T_5$). In this case, $T_2$ and $T_5$ were about 3" away from the heat source. In one composite, upper and lower surfaces of the top assembly were painted black. In the other composite, the top surface of the top assembly was painted black and the top surface of the bottom assembly was painted black.

TABLE 4

| Location of Dimensions Measured Temperatures | Measured Temperatures (°F.) & Composite | |
|---|---|---|
| | 6" × 53" Top Assy Both Sides Black/Bottom Assy Bright | 6" × 53" Top Assy Top Surface Black/ Bttm Assy Top Surface Black |
| $T_1$ Top Center | 135 | 135 |
| $T_2$ Top Edge | 132 | 128 |
| $T_3$ Bottom Center | 194 | 188 |
| $T_4$ Heat Source | 500 | 500 |
| $T_5$ Bottom Edge | 183 | 184 |

While the invention has been described with reference to the foregoing embodiments, various changes and modifications can be made thereto which fail within the scope of the appended claims.

What Is Claimed Is:

1. A heat distributing device comprising:

a localized and concentrated heat source; and a stack of layers of metal foil wherein the layers of foil are arranged one above another, the layers of the metal foil being spaced apart sufficiently to allow thermal convection therebetween, the heat source being encapsulated between layers of the metal foil such that a plurality of layers of the metal foil are on a first side of the heat source and at least one layer of the metal foil is on a second side of the heat source.

2. The heat distributing device of claim 1, wherein a plurality of layers of the metal foil are located on both sides of the heat source.

3. The heat distributing device of claim 1, wherein at least one of the layers of metal foil includes a pattern of embossments therein separating the layers to allow thermal convection in spaces therebetween and provide thermal conduction at spaced-apart points of contact between the embossments and an adjacent one of the layers.

4. The heat distributing device of claim 1, wherein each of the layers of metal foil includes a pattern of embossments therein to allow thermal convection in spaces between the embossments and thermal conduction at points of contact between the embossments and an adjacent one of the layers.

5. The heat distributing device of claim 3, wherein one of the layers of the metal foil on the first side of the heat source is an outermost layer which is flat.

6. The heat distributing device of claim 1, wherein the layers of metal foil are of aluminum or an aluminum alloy.

7. The heat distributing device of claim 1, wherein the layers of metal foil are not metallurgically bonded together.

8. The heat distributing device of claim 1, wherein at least one of the layers of metal foil includes a black coating on at least one side thereof.

9. The heat distributing device of claim 8, wherein the black coating covers an outer surface of the composite.

10. The heat distributing device of claim 1, wherein the stack includes an insulating material between at least some of the layers of metal foil.

11. The heat distributing device of claim 1, wherein the stack included metal wool between at least some of the layers of metal foil.

12. The heat distributing device of claim 10, wherein the insulating material comprises one or more sheets of an electrically nonconductive material.

13. The heat distributing device of claim 1, wherein the heat source comprises an electrical resistance heating element including a rod or wire of resistance heating material.

14. The heat distributing device of claim 13, wherein the electrical resistance heating element comprises an electrically conductive metal rod or wire coated with a layer of non-electrically conductive material.

15. The heat distributing device of claim 14, wherein the rod or wire has a free end spaced inwardly from an outer periphery of the stack.

16. The heat distributing device of claim 1, wherein heat source comprises a conduit in which heated gas or liquid can be circulated.

17. The heat distributing device of claim 13, wherein the electrical resistance heating element comprises an electrically conductive polymer material.

18. The heat distributing device of claim 13, further comprising a side view mirror of a vehicle, the layers of metal foil on the one side of the heat source being attached to a rear surface of the mirror.

19. The heat distributing device of claim 1, wherein one of the layers of metal foil comprises an outermost layer of the stack and the layers of the metal foil between the heat source and the outermost layer prevent the outermost layer from reaching a temperature higher than 200° F. when the heat source is heated to 400° F.

20. The heat distributing device of claim 14, wherein one of the layers of metal foil comprises an outermost layer of the stack and the outermost layer varies in temperature by no more than ±5° F. at any location on the outermost layer when the heat source heats the outermost layer from a first temperature to a second temperature which is at least 100° F. higher than the first temperature.

21. The heat distributing device according to claim 1, wherein said heat source comprises an electrical resistance heating filament inside a tube.

22. The heat distributing device according to claim 21, wherein said filament comprises Ni-chrome wire.

23. The heat distributing device according to claim 21, wherein the tube comprises a material selected from the group consisting of glass, pyrex, ceramic, fiberglass, and plastic.

24. The heat distributing device according to claim 21, wherein said filament is supported in said tube by at least one spacer.

25. The heat distributing device according to claim 21, wherein said tube includes a fluid medium surrounding the filament.

26. The heat distributing device according to claim 21, wherein said filament passes through opposite ends of the tube.

27. A heat distributing device comprising:

a heat source comprising a wire of resistance heating material;

a stack of layers of metal foil wherein the layers of foil are arranged one above another, the layers of the metal foil being spaced apart sufficiently to allow thermal convection therebetween, the heat source being encapsulated between layers of the metal foil such that a plurality of layers of the metal foil are on a first side of the heat source and at least one layer of the metal foil is on a second side of the heat source; and a mirror, the layers of metal foil on the one side of the heat source being attached to a rear surface of the mirror.

28. A heat distributing device comprising:

a small high intensity heat source capable of distributing heat over a large area, the heat source comprising a rod or wire of an electrical resistance heating material;

a stack of layers of metal foil wherein the layers of foil are arranged one above another, the layers of the metal foil including embossments which provide point contact between the layers of foil and allow thermal convection between the layers of foil, the heat source being encapsulated between two adjacent layers of the metal foil such that a plurality of layers of the metal foil are on a first side of the heat source and at least one layer of the metal foil is on a second side of the heat source, the heat source being non uniformly distributed in the stack such that the heat source is only located in a localized area of the stack, the layers of metal foil being effective to uniformly distribute heat over a large area of the stack and heat an outermost layer of the stack to a substantially uniform temperature at any location on the outermost layer.

29. The heat distributing device of claim 28, wherein the stack is tapered such that the layers of foil are closer together on one part of the stack than on an opposite part of the stack.

30. The heat distributing device of claim 28, wherein the heat source is rectilinear and a free end of the heat source is located inwardly from an outer edge of the stack.

31. The heat distributing device of claim 28, wherein the heat source has a diameter of about $\frac{1}{8}$ inch and the stack is at least 6 inches wide.

* * * * *